US005080509A

United States Patent [19]

Stone

[11] Patent Number: 5,080,509

[45] Date of Patent: Jan. 14, 1992

[54] ENVELOPE PRINTING MECHANISM

[75] Inventor: Bernard D. Stone, Ambler, Pa.

[73] Assignee: Addressease, Inc., Maple Glen, Pa.

[21] Appl. No.: 651,024

[22] Filed: Feb. 5, 1991

Related U.S. Application Data

[63] Continuation-in-part of Ser. No. 475,783, Feb. 6, 1990, Pat. No. 5,035,521.

[51] Int. Cl.[5] ..... B41J 3/28

[52] U.S. Cl. ..... 400/23; 400/44; 400/279; 400/634; 400/708; 271/2; 271/902; 101/47; 395/275

[58] Field of Search ..... 400/48, 551, 576, 23, 400/27, 29, 30, 44, 47, 56, 279, 545, 546, 605, 634, 636, 637, 641; 364/419, 518, 519; 101/47

[56] References Cited

U.S. PATENT DOCUMENTS

| | | | |
|---|---|---|---|
| 3,822,375 | 7/1974 | Ozekl et al. | 400/62 |
| 3,923,135 | 12/1975 | Holman et al. . | |
| 4,031,519 | 2/1977 | Findley . | |
| 4,186,659 | 2/1980 | Rogers et al. | 101/47 |
| 4,441,420 | 4/1984 | Buan | 271/2 |
| 4,575,267 | 3/1986 | Brull . | |
| 4,624,588 | 11/1986 | Bivin . | |
| 4,741,635 | 5/1988 | Shibata et al. | 400/61 |
| 4,744,296 | 5/1988 | Edwards et al. . | |
| 4,818,126 | 4/1989 | Brooks et al. . | |
| 4,828,416 | 5/1989 | Pensavecchia et al. . | |
| 4,846,594 | 7/1989 | Riskin . | |
| 4,944,620 | 7/1990 | Scozzafava et al. | 400/641 |
| 4,946,298 | 8/1990 | Oka et al. | 400/605 |
| 4,991,983 | 2/1991 | Graverholt | 400/708 |

FOREIGN PATENT DOCUMENTS 3211451 10/1982 Fed. Rep. of Germany .

OTHER PUBLICATIONS

Computer Reseller News Nov. 20, 1989, p. 112.

*Primary Examiner*—Eugene H. Eickholt
*Attorney, Agent, or Firm*—Howson & Howson

[57] ABSTRACT

The elements of a printing mechanism, including a platen, print head and drive motors, are constructed and arranged to provide a clearance permitting an envelope to remain entirely in a flat condition in a plane tangent to the platen at the location of the printing line while the envelope is being printed by the print head. The housing of the printing mechanism is constructed with specially configured slots. First and second opposite end walls of the housing, and a third wall, extending from one end wall to the other, provide at least partial coverage of the print head and platen. The third wall has a slot extending from one end wall to the other, the slot being arranged to receive an envelope and to allow the envelope to be inserted in a flat condition between the print head and the platen. The end walls have parallel slots, meeting and continuous with the slot of the third wall. The parallel slots of the end walls are aligned with the plane which is tangent to the platen at the location of the printing line, so that the envelope being printed can extend outwardly from the housing through all three slots. A line feed control system automatically positions an envelope, which may vary in size, to the correct line position before printing an address. Sensors mounted in the slots detect the presence of an envelope at several positions. A microcomputer responsive to sensor outputs causes a line feed drive to position the envelope.

19 Claims, 11 Drawing Sheets

ENVELOPE PRINTING MECHANISM

CROSS REFERENCE TO RELATED APPLICATION

This is a continuation-in-part of U.S. patent application No. 07/475,783, filed Feb. 6, 1990, now U.S. Pat. No. 5,035,521.

BRIEF SUMMARY OF THE INVENTION

This invention relates to printers, and more specifically to a printing mechanism adapted to imprint destination addresses on mailing envelopes.

With the increasing use of word processors and personal computers programmed to perform word processing functions, a need has arisen for a simple and convenient means to print correspondence addresses on mailing envelopes.

A typical stand-alone word processing station comprises a personal computer, a keyboard, a video display device, and a printer. The printer may take any of a variety of forms. In most cases, daisy wheel printers, dot matrix printers, ink jet printers, or laser printers are used. While most such printers can be used to print envelopes, only the more expensive versions of these printers are capable of handling the printing of addresses on envelopes satisfactorily.

With daisy wheel and dot matrix printers, and with some of the ink jet printers, it is necessary to insert envelopes manually behind a typewriter-type platen and to roll the platen until the envelope wraps around it and moves to the appropriate printing position. Automatic envelope loading devices are available, but they are generally expensive, and some are unreliable. The more expensive printers which are capable of handling envelopes satisfactorily are often shared by two or more word processing stations. It is inconvenient to use a shared printer for printing envelopes.

Furthermore, prior art printers are incapable of efficiently handling the many sizes of mailing envelopes in present use by businesses. One U.S. business supply catalog, for instance, offers envelopes in 24 different heights ranging from 2½" to 12" (6.3 cm to 30.5 cm) and 25 different widths ranging from 4½" to 15½" (11.4 cm to 39.4 cm). The larger mailing envelopes are therefore ordinarily addressed by means of labels, usually of the kind having a pressure-sensitive adhesive layer protected by a peelable release liner. It is inconvenient to print addresses on these labels using daisy wheel, dot matrix and ink jet printers, and many problems have arisen in connection with attempts to print such labels using laser printers.

As a result of the difficulties encountered in using conventional word processing printers for printing addresses or the high costs for special purpose printers, it is a common practice to provide a conventional typewriter as an adjunct to a word processing station primarily for the purpose of addressing envelopes and labels.

The principal object of this invention is to provide an inexpensive printing device, capable of being driven by a dedicated word processor or personal computer, for printing addresses on mailing envelopes. It is also an object of the invention to provide an envelope printing device which is capable of handling envelopes in a wide range of sizes. Another object is to provide a novel housing for a printing apparatus suitable for positively retaining an envelope in an entirely flat condition while the envelope is being printed. Still another object of the invention is to provide an improved envelope printing apparatus capable of printing addresses on envelopes of different size at their correct line locations. Other objects of the invention include compactness, reliability, simplicity and ease of use.

The envelope printing mechanism in accordance with the invention comprises a platen and printing means movable relative to the platen for printing characters in sequentially printed lines on an envelope, and means for effecting line feed movement of the envelope following printing of each line.

One version of the printing mechanism utilizes a number of essentially conventional components including a roller platen, and a print head located adjacent to the platen for printing characters along a printing line on an envelope located between the print head and the platen. A first drive effects relative movement of the print head and platen along a direction parallel to the platen's axis of rotation. Rollers or other suitable pressure devices are provided to hold an envelope against the platen. A second drive effects line feed rotation of the platen. In another version, the platen takes the form of a flat surface arranged so that the envelope can be inserted between the print head and the flat surface. Line feeding movement of the envelope during printing is effected by a driven roller remote from the location of the print head. The roller causes the envelope to slide on the flat platen surface.

An important feature which distinguishes the printing mechanism of the invention from a conventional printer is the fact that the elements of the printing mechanism are constructed and arranged to provide a clearance permitting an envelope to remain entirely in a flat condition while the envelope is being printed. This arrangement greatly simplifies envelope insertion, and permits printing on envelopes of any size.

To accommodate envelopes of large size, and also to facilitate positioning of an envelope so that printing takes place in the desired area on its face, the housing containing the platen, print head and drives is constructed with specially configured slots. First and second opposite end walls of the housing, and a third wall extending from one end wall to the other, provide at least partial coverage of the print head and platen. The third wall has a slot extending from one end wall to the other, the slot being arranged to receive an envelope and to allow the envelope to be inserted in a flat condition between the print head and the platen. The end walls have parallel slots, meeting and continuous with the slot of the third wall. The parallel slots of the end walls are aligned with a plane which is tangent to the platen at the location of the printing line, so that the envelope being printed can extend outwardly from the housing through all three slots.

The printing mechanism can be provided with a vertical slot for downward envelope insertion or with a horizontal slot. In the case of a horizontal slot the printing mechanism is preferably designed to receive the envelope top first, and to print the lines of the address in reverse order. A printing unit can be made convertible for horizontal or vertical slot operation.

Still another improvement according to the invention includes a unique line feed control system for automatically positioning various size envelopes in the printing mechanism at the correct line position before printing an address. Sensors mounted in the slots detect the presence of the envelope at several positions. A microcomputer responsive to sensor signals fed to a line feed drive causes the envelope to be positioned at the appropriate address line before the mechanism begins printing.

Further objects and advantages of the invention will be apparent from the following detailed description, when read in conjunction with the drawings.

DETAILED DESCRIPTION

Figure 1:
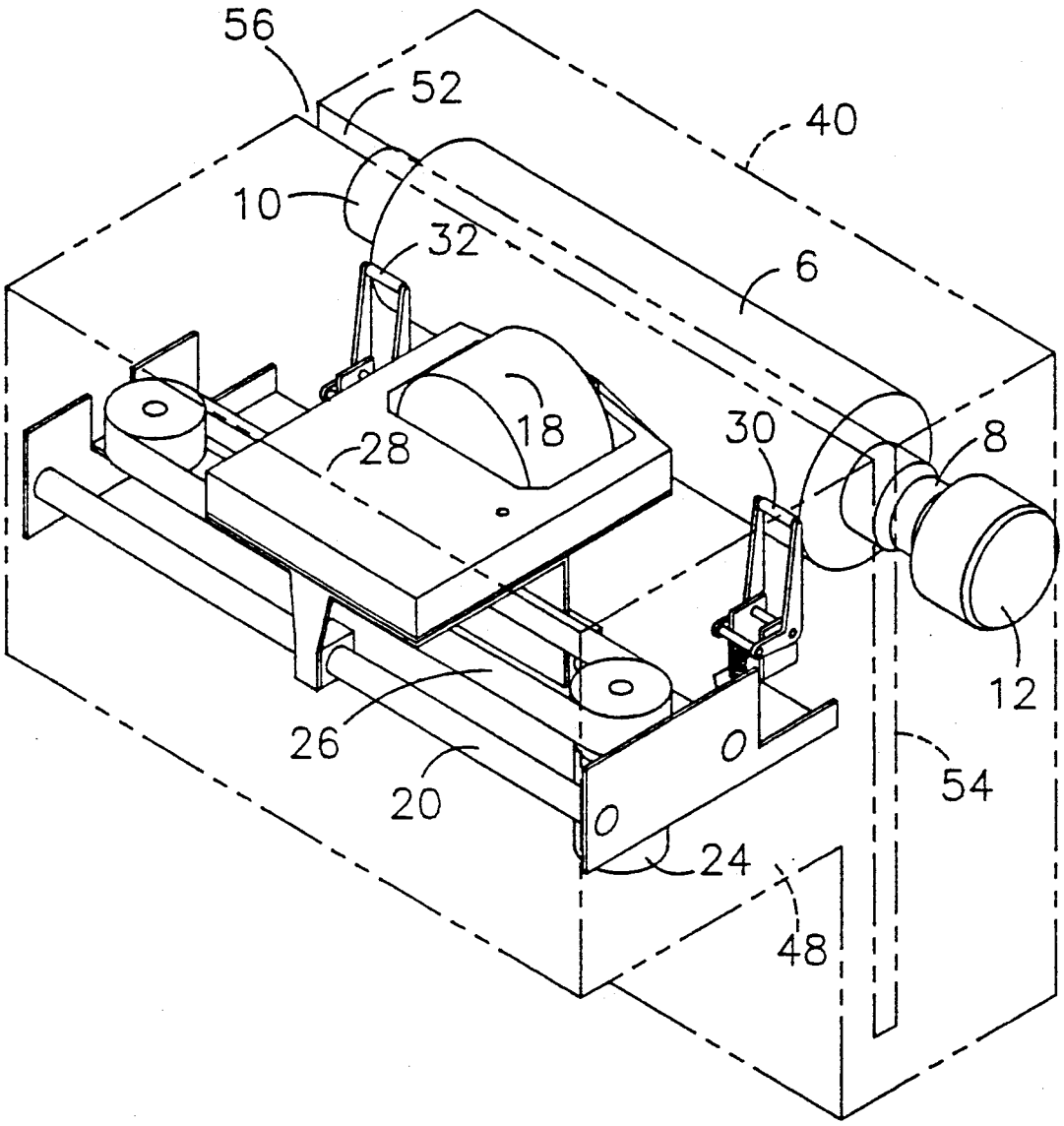
FIG. 1 is an isometric view of one embodiment of a printing mechanism in accordance with the invention, showing the printer housing and envelope-receiving slots in broken lines.
Figure 2:
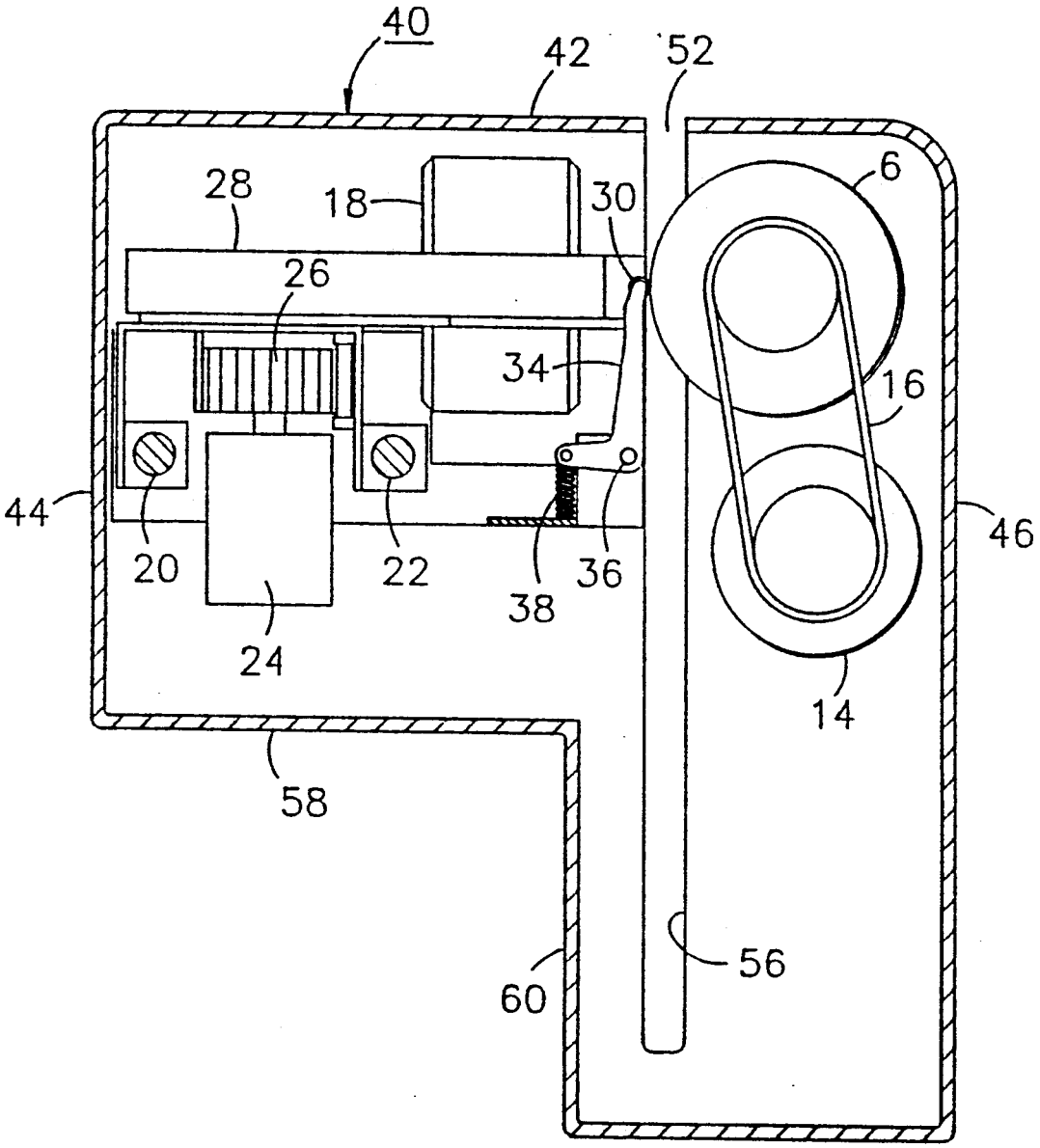
FIG. 2 is a vertical section of the printing mechanism.

Referring to FIG. 1, which shows a preferred embodiment of the invention, the printing mechanism comprises a cylindrical roller platen 6 arranged to rotate on a horizontal axis in bearings 8 and 10. A knob 12 is provided for manual rotation of the platen. The diameter of the platen can be smaller than that of a conventional printer or typewriter platen, as there is no need to wrap stationery around the platen. Thus, the diameter of the platen can be as little as one inch or even less. Its length does not need to be any greater than the maximum length of a printed address, and can be as little as 4½ inches. A platen drive motor 14, which may be a stepping motor, is shown in FIG. 2. It drives platen 6 through a drive belt 16.

A print head 18, for example a conventional 24-pin dot matrix print head, is arranged to move along the platen in a direction parallel to the platen axis, being guided along horizontal bars 20 and 22. The print head is driven by a second stepping motor 24 through a belt 26. A ribbon cartridge 28 is carried along with the print head 18.

A pair of rollers 30 and 32 are arranged in pivoting frames and urged by compression springs against the surface of platen 6 adjacent to both ends of the platen. As shown in FIG. 2, roller 30 is held in frame 34, which is pivoted on pin 36 and urged clockwise by compression spring 38 so that the roller is pressed against the platen. The frame and spring holding roller 32 against the platen are similar. The purpose of these rollers is to hold an envelope against the platen so that platen rotation frictionally feeds the envelope outwardly as printing progresses. The rollers are preferably aligned with the printing line.

Figure 3:
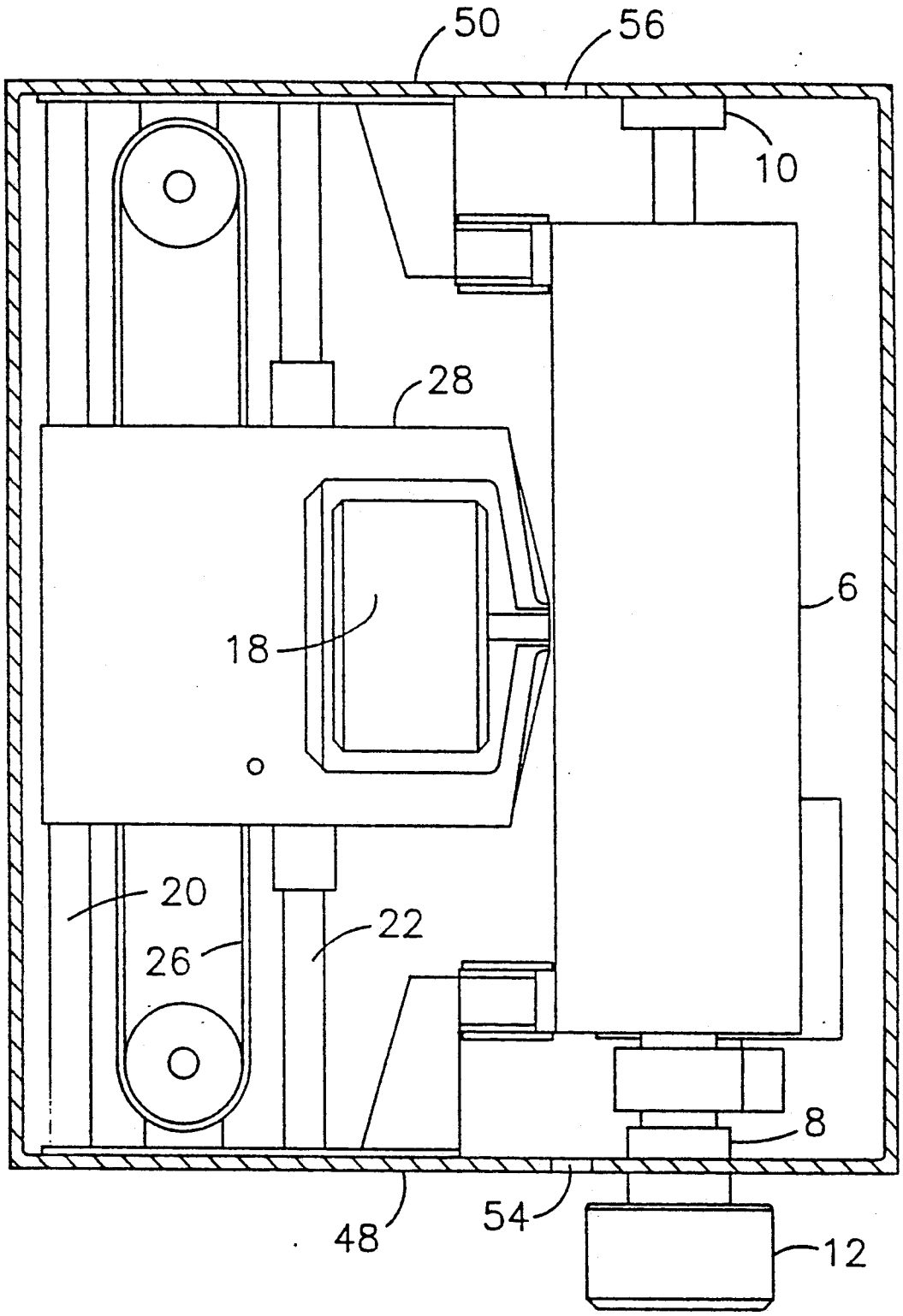
FIG. 3 is a horizontal section in which the printing mechanism is viewed from above.
Figure 4:
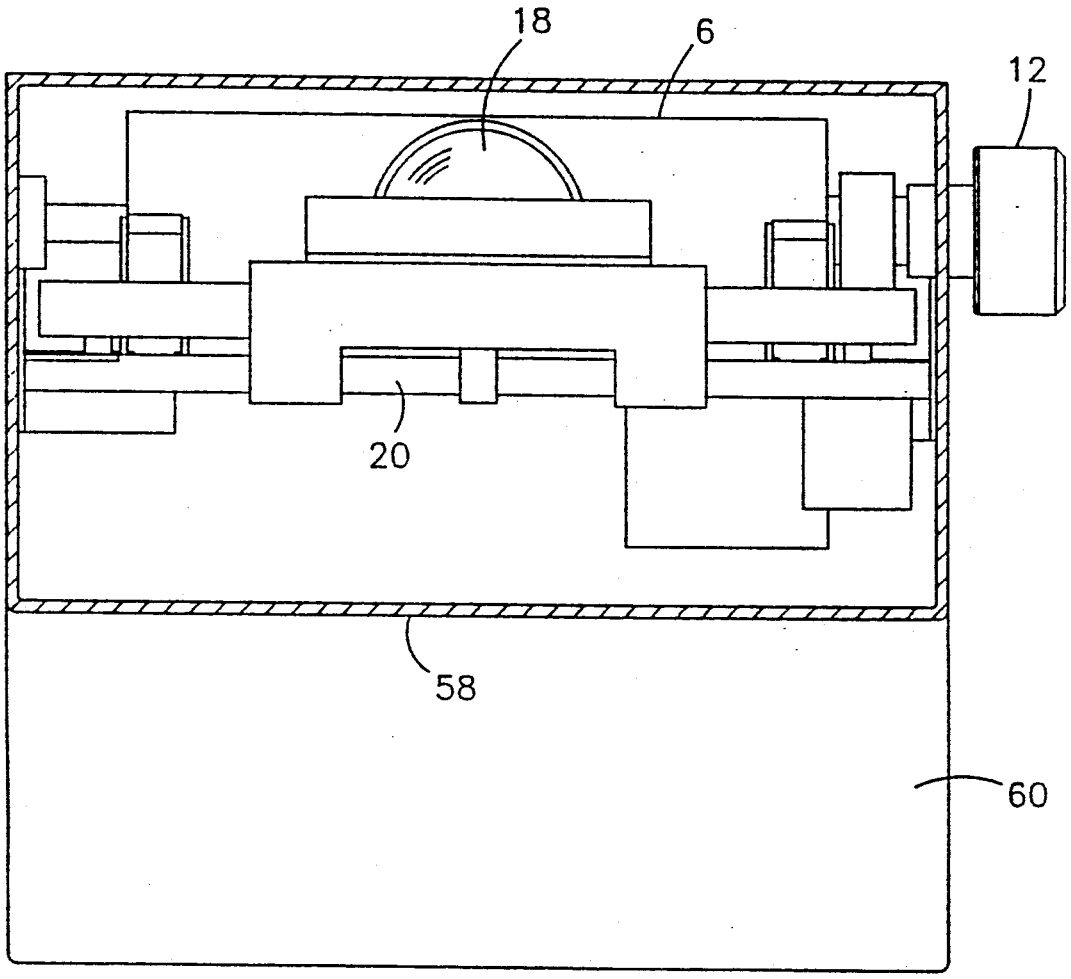
FIG. 4 is a vertical section in which the printing mechanism is viewed from the rear.

The platen, print head and drive mechanism are enclosed in a housing 40. The housing has a top wall 42, and front and rear walls 44 and 46, as shown in FIG. 2. It also has side walls 48 and 50, as shown in FIG. 3.

The top wall 42 has a slot 52 extending parallel to the axis of the platen and located directly above the location at which printing takes place. Slot 52 extends from one side wall to the other, and is continuous with vertical slots 54 and 56 formed in the side walls. This allows the printer mechanism to accommodate even the largest envelopes by locating three of its edges entirely outside the housing while a portion of the face of the envelope is within the housing and positioned to be printed in the address site. The spacing between the side walls must be great enough to print the maximum width address contemplated, approximately 4" (10.2 cm). With the addition of support structure, print head mechanisms, etc. the practical minimum spacing is approximately 5" to 6" (12.7 cm to 15.3 cm). This spacing will conveniently accommodate all standard envelope sizes except those less than 6" (15.3 cm) such as invitation or RSVP style envelopes.

A practical maximum spacing between the sidewalls would be approximately 8½" (21.6 cm). Slots 54 and 56 in the side walls extend well below the level at which printing takes place, so that addresses can be printed on large envelopes at the appropriate locations. As seen in FIG. 2, the elements of the printing mechanism are arranged to provide a clearance below the printing location, allowing envelopes to be situated in a flat condition while being printed.

Because of the length requirements for slots 54 and 56, it is desirable to shape the housing 40, as shown in FIG. 2, with a bottom wall 58 below the print head drive mechanism, and a rear section 60 extending downward below the level of bottom wall 58. The housing can be positioned with bottom wall 58 resting on the edge of a table and section 60 extending downward below the level of the table. This reduces the overall height of the printer and makes it easier to insert envelopes into slot 52, while allowing the printer to accommodate large envelopes.

To use the printer to address an envelope, the operator inserts the envelope between the platen and print head until it reaches a position in which the print head is adjacent to the point on the envelope at which printing is to begin. The envelope is inserted between the platen and rollers 30 and 32, and can be manually pushed downward to the desired position. Platen drive motor 14 is not energized except when printing or line feeding is taking place, and, when not energized, allows the platen to rotate counterclockwise (as viewed in FIG. 2) when the envelope is pushed downward. During insertion, the envelope can alternatively be moved downward by counterclockwise rotation of the platen control knob 12.

The address to be printed on the envelope can be derived from a list in a computer memory, entered manually into the word processor separately from the correspondence being mailed, or derived from the inside address on the correspondence by means of suitable software. In any case, the address data is directed to the printer, which then prints the address on the envelope, indexing the envelope outwardly each time it receives a line feed code. When printing is complete, the envelope can be ejected automatically by platen rotation, or it can be removed from the printer manually.

The principal advantage of the arrangement allowing the envelope to remain in a flat condition is that it is easy to insert the envelope manually, and unnecessary to wrap it around a platen. This makes it possible to print on large, e.g. 9"×12" or 10"×15", envelopes. If mailing labels are desired, they can be attached to the large envelopes before printing. The envelopes can easily be positioned in the printer so that printing takes place on the labels.

Figure 5:
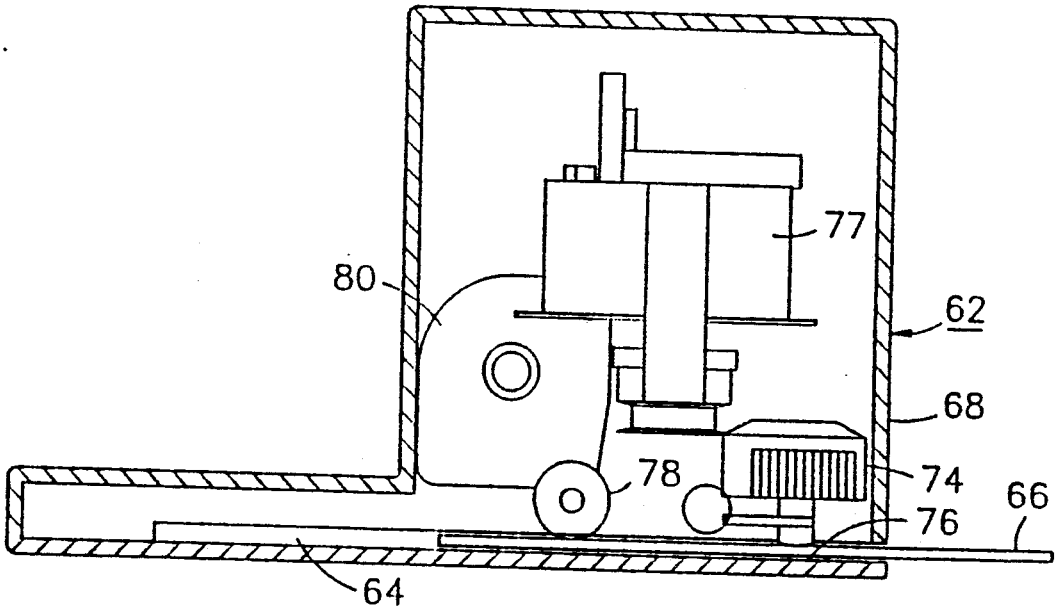
FIG. 5 is a side view in vertical section of an alternative embodiment of the invention using a flat platen at the print head location and an envelope feeding roller spaced from the print head.
Figure 6:
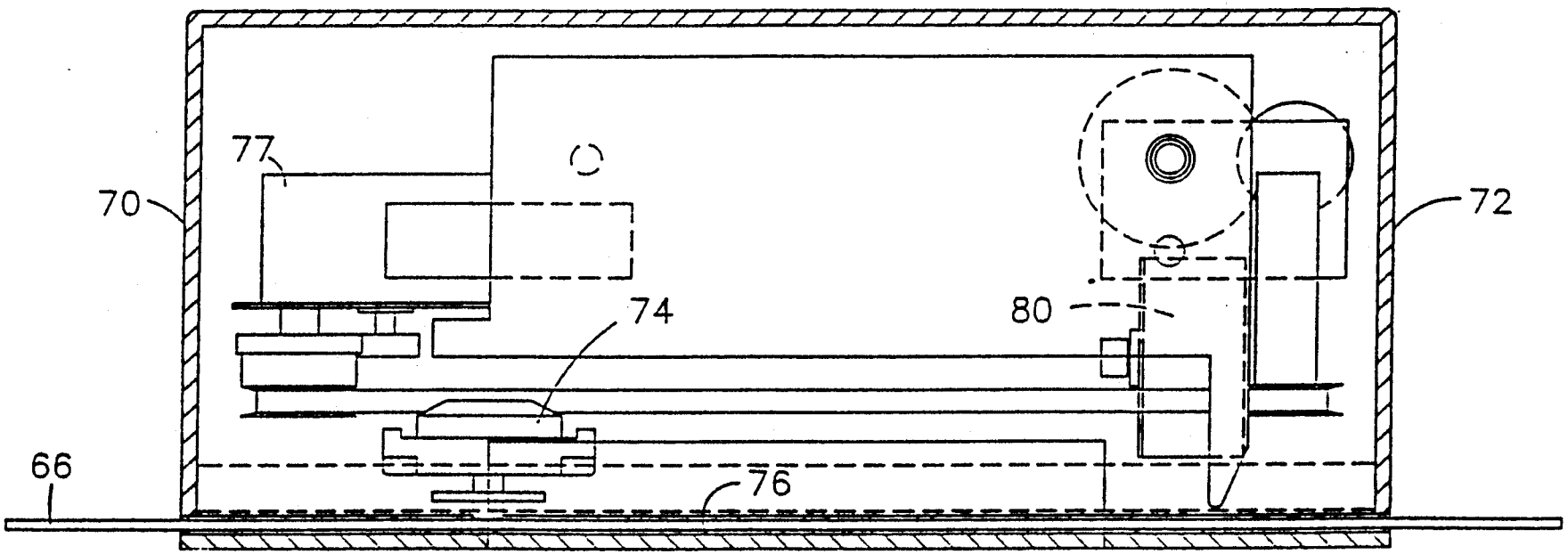
FIG. 6 is a front view in vertical section of the embodiment of FIG. 5.

In the embodiment shown in FIGS. 5 and 6, the housing 62 has a slot in its front wall 68 and slots in its sidewalls, together providing a horizontally extending clearance 64 for receiving an envelope 66. The envelope is inserted through the slot opening in front wall 68, and may extend outwardly through either or both of the side walls 70 and 72 as shown in FIG. 6. A dot matrix print head 74, is driven by motor 77 for lateral movement across the surface of the envelope in a direction parallel to front wall 68. A surface 76 underneath the envelope serves as a platen. It provides a firm backing for the envelope, allowing the print head pins to operate effectively, and also allows the envelope to slide inwardly during envelope insertion, and outwardly as the envelope is fed mechanically during line feed motion of the printing mechanism.

Line feed motion is effected by a friction roller 78, which is driven by a motor drive mechanism 80. The drive mechanism for roller 78 is preferably similar to the drive mechanism for the roller platen in FIGS. 1-4 in that it is designed to permit free rotation of the roller except during printing and line feeding. In this way, it is possible for an envelope to be inserted manually into position between roller 78 and platen surface 76 without the need for manual release of the roller.

In operation of the printing mechanism of FIGS. 5 and 6, the envelope is inserted into the slot until the location of the first line of printing is underneath the print head. Roller 78 indexes the envelope outwardly after each line is printed, and the envelope can be removed manually when printing is complete.

In FIG. 5, the envelope can be inserted bottom-first into the slot so that the flap opening of the envelope extends outward from the slot opening in front wall 68. However, bottom-first envelope insertion is unnatural, and therefore undesirable, when the slot is horizontal. To permit top-first envelope insertion, the printer driving software or firmware can provide a buffer allowing the address lines to be printed in reverse order, with the bottom line of the address printed first, and the top line printed last.

The printer driving software or firmware may be provided with a special character set so that the print head can be made to print characters right-side up or upside down. This allows the printing mechanism of FIGS. 5 and 6 to be positioned as shown for top first horizontal envelope insertion or rotated so that its slot is vertical for bottom-first envelope insertion.

Figure 7:
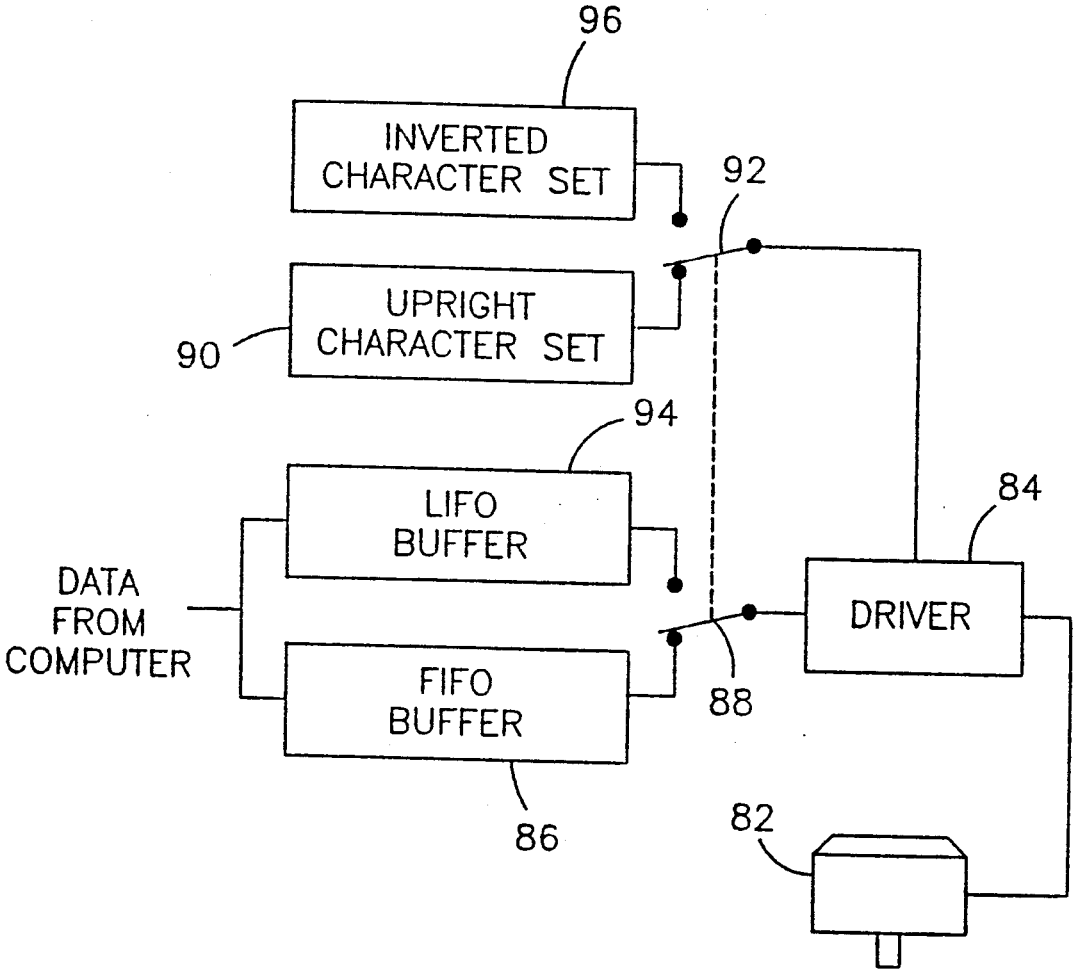
FIG. 7 is a block diagram schematically illustrating the manner in which the print head is driven.

FIG. 7 shows a print head 82 driven by a conventional print head driver 84. Data from a computer is delivered to the driver through a conventional first-in, first-out (FIFO) buffer 86 and a switch 88. A character set memory 90, which may take the form of a programmed read-only memory (PROM), is connected to driver 84 to establish a conventional upright character set. The connection is through a switch array represented by switch 92.

The driving electronics as described above is used when the envelope printer is used to print on envelopes inserted bottom first. However, when the slot is horizontal, and the envelopes are inserted top first, switches 88 and 92 are thrown in order to utilize a last-in, first-out (LIFO) character buffer 94, and an inverted character set memory 96. This allows the same print head 82 to be used either to print in the conventional manner, or to print characters upside-down and in reverse order.

Figure 8:
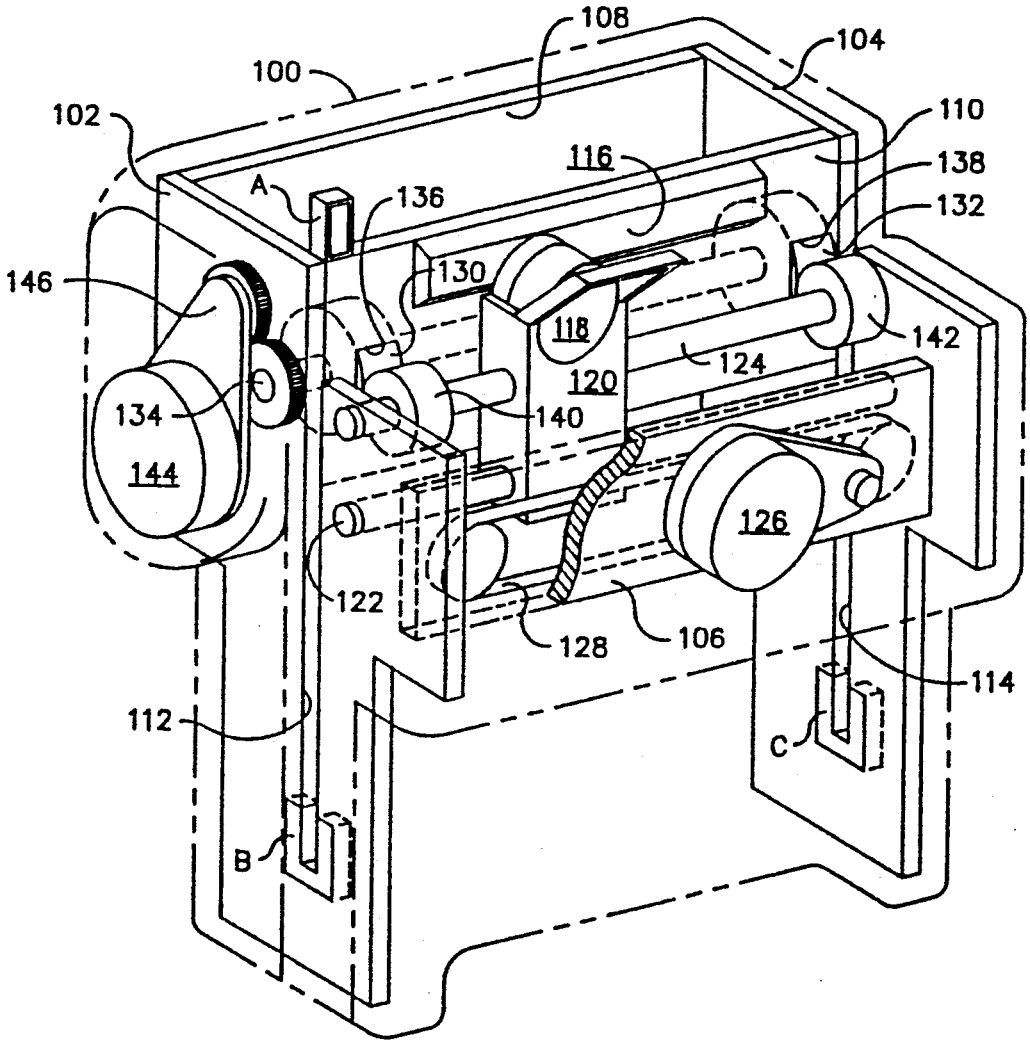
FIG. 8 is an isometric view of another alternative embodiment of an envelope printing mechanism according to the invention with the general outline of the housing illustrated in broken lines.

Referring now to the embodiment of FIG. 8, there is shown in broken outline a housing 100 conforming generally to the outline of the assembled components of an envelope printing mechanism. Support structure for the components includes parallel side panels 102 and 104 fixed in spaced relation by front and rear panels 106 and 108 and intermediate panel 110. Side panels 102 and 104 have coplanar slots 112 and 114 extending downward a distance sufficient to allow the printing mechanism to print addresses at the appropriate location of the largest envelope contemplated. The ends of intermediate panel 110 are disposed along the rearward edges of slots 112 and 114 and provide a support surface for an elongate platen 116 mounted lengthwise between sides 102 and 104. The exposed lengthwise edges of platen 116 are preferably beveled to allow an envelope to pass by without jamming.

Characters of an address are printed along a line coinciding with platen 116 by a print head 118 carried along by a carriage 120 on parallel upper and lower guide bars 122 and 124 in a manner similar to the embodiment of FIG. 1. The print head and carriage are traversed along guide bars 122 and 124 for character spacing by a stepping motor 126 and drive belt 128 respectively mounted on opposite sides of front panel 106.

Envelopes are transported along slots 112 and 114 by pinch rollers 130 and 132 rotatable with shaft 134 on an axis parallel to upper guide bar 124. Rollers 130 and 132 protrude through apertures 136 and 138 of panel 110 to a plane within slots 112 and 114 and meet idlers 140 and 142, respectively, which are rotatably mounted on upper guide bar 124. The cylindrical surfaces of pinch rollers 130 and 132 are preferably constructed of a resilient material such as rubber to provide sufficient friction to drive an envelope along the slots. A line feed stepping motor 144 and gear train 146 mounted on the exterior of side panel 102 drives pinch rollers 130 and 132 for transporting the envelope line-by-line across the width of platen 116.

The positioning of an envelope at the appropriate spacing from the bottom edge of the envelope is accomplished by a unique computer program responsive to proximity sensors mounted on the support members of the printing mechanism. A sensor A mounted on intermediate panel 110 at the entrance to slot 112 detects the presence of an envelope at the top of slot 112, and sensors B and C mounted in side panels 102 and 104 at the bottom of slots 112 and 114, respectively, detect when the envelope is fully inserted. Sensors B and C may be spaced closer together than side panels 102 and 104 in order to accommodate very "short" envelopes. However, it is contemplated that the spacing of the side panels with sensors B and C therein should be sufficient for the vast majority of envelope sizes. Preferably, the spacing should be close enough for a standard personal-size envelope, approximately 5.5" (14.0 cm) wide, or a business-size envelope 8.5" (21.6 cm) to extend out of both slots 112 and 114 while allowing printing a maximum width address of approximately 4" (10.2 cm). With addition of support structure, print head drive mechanisms, etc., a practical minimum spacing is found to be approximately 5" to 6" (12.7 cm to 15.2 cm).

Figure 10:
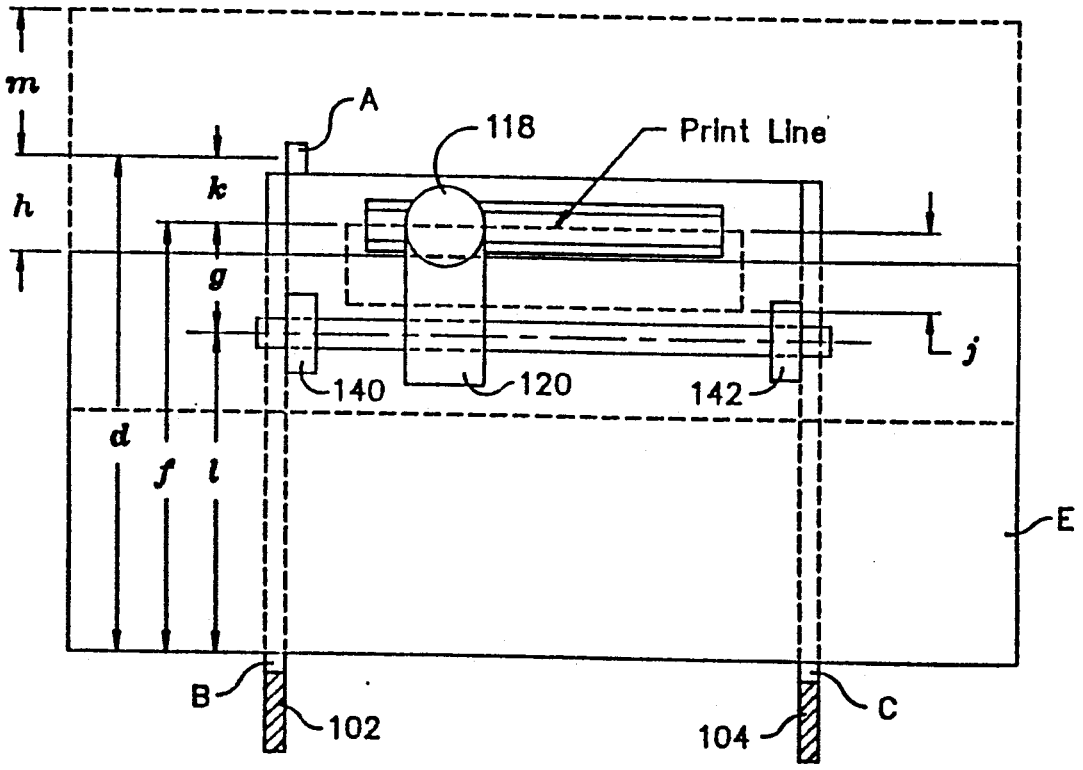
FIG. 10 is a schematic representation of the printing mechanism of FIG. 8 with a typical envelope inserted for printing an address.

Referring to FIG. 10, there are four vertical dimensions d, e, f and g in the printer mechanism determined by a selected range of envelope heights. Deviations from these measurements, of course, are possible without departing from the fundamental inventive concept.

Dimension d is the distance from the envelope sensor A to the sensors B and C and corresponds to the highest envelope in the selected range that will be treated as a "short" envelope. Dimension d is preferably between 4.25" and 6" (10.8 cm to 15.2 cm). The minimum of 4.25" (10.8 cm) ensures that a #10 business envelope 4⅛" (10.5 cm) will be properly positioned.

Dimension e is the distance from the interface of pinch and idler rollers 130, 132 and 140, 142 to sensors B and C and corresponds to the shortest envelope to be accommodated, preferably about 3.5" (8.9 cm) for all but the shortest specialty envelopes. An envelope that is shorter than this distance will be "dropped" by the rollers before it reaches sensor B and C and must be manually retrieved.

The position where addresses will be printed on "tall" envelopes is determined by dimension f measured between sensor B and the print line of print head 118. To accommodate the widest possible range of envelope heights, dimension f is chosen to provide a print line reasonably close to the center of the selected range of envelope heights, keeping in mind that the first line printed, i.e. the extreme distance between print head 118 and the inserted edge of the envelope, may be the first line of the address when the printer is vertically oriented, or the last line when the printer is horizontal. Dimension f is preferably 4.5" to 5" (11.4 cm to 12.7 cm) in order to obtain acceptable results on the widest range of envelope heights, e.g. 7" to 10" (17.8 cm to 25.4 cm). While a distance of 5" (12.7 cm) will not work well on envelopes that are 7" (17.8 cm) high, reasonable results are produced on 7.5" (19.0 cm) envelopes, and with even better results on larger envelopes up to 12" (30.5 cm) high.

Dimension g is measured between the interface line of the pinch and idler rollers and the print line, preferably less than 1" (2.54 cm). If too large, a "short" envelope will exit from between the rollers before the last line of the address has been printed. If greater than 1" (2.54 cm), it would be impossible to print properly on an envelope less than about 3.5" (8.9 cm) high.

Figure 9:
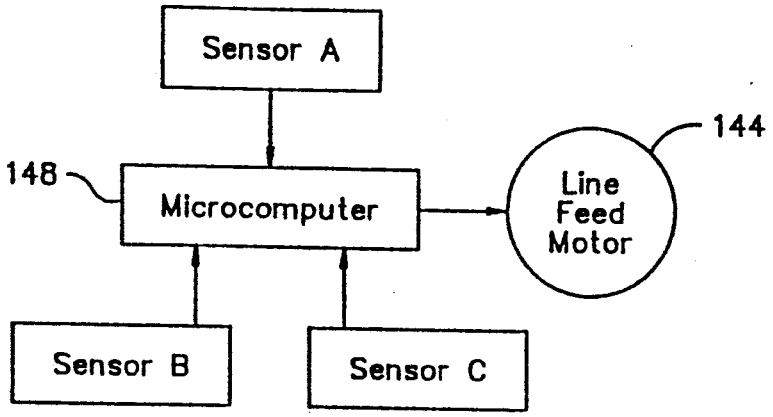
FIG. 9 is a block diagram of a line feed control system as applied to the printing mechanism of FIG. 8.

Referring now to the general block diagram of FIG. 9 for the automatic line feed system. Proximity signals from sensors A, B and C are delivered to a microcomputer 148 for regulating control line feed stepping motor 144. Microcomputer 148 is preferably mounted within the printing mechanism of FIG. 8 at any convenient location, although an external computer may also be utilized instead.

Figure 11:
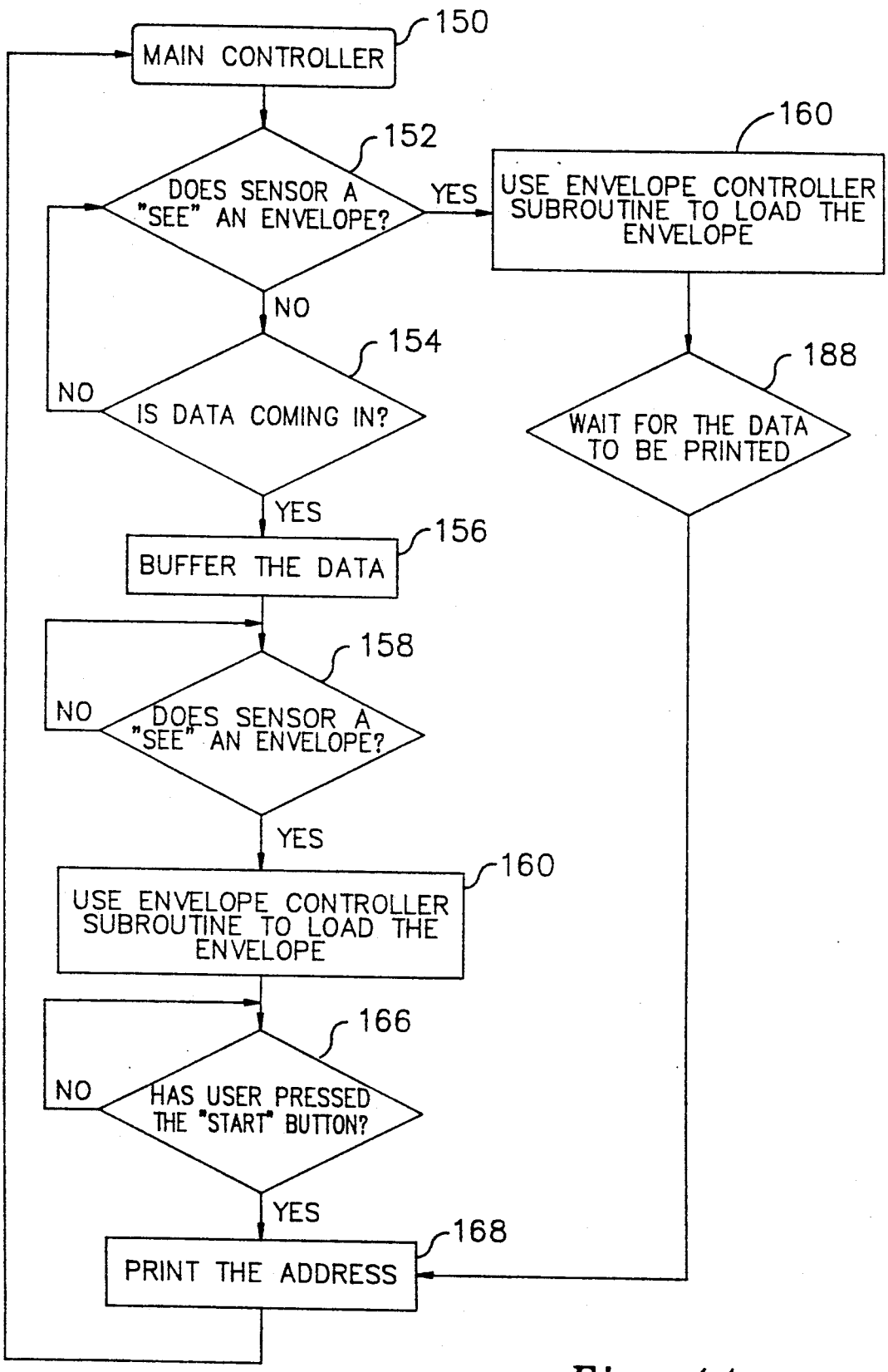
FIGS. 11 and 12 are flow charts of a computer program for use in the line feed control system of FIG. 9.
Figure 12:
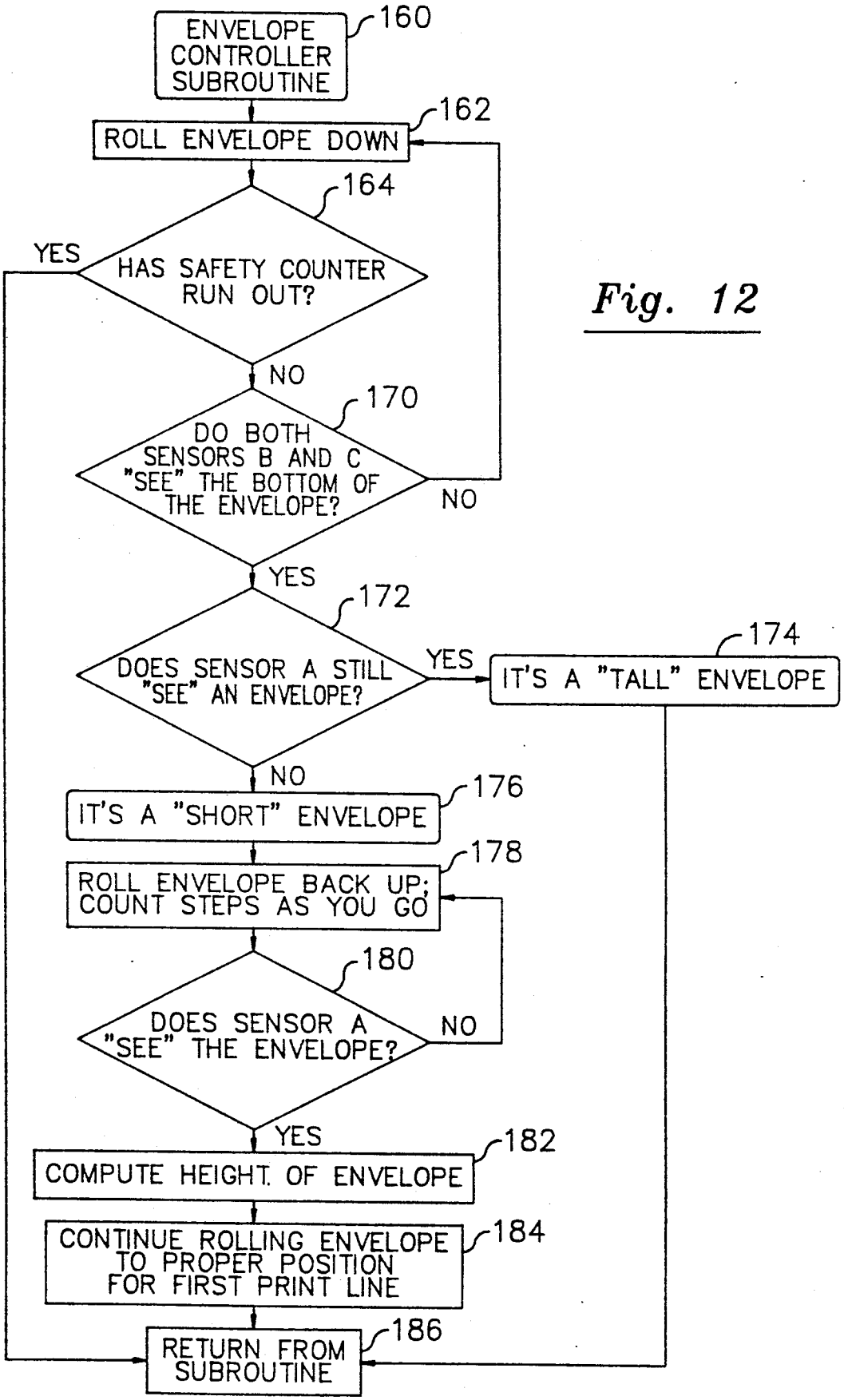

The process, programmed in any well-known manner in microcomputer 148, executes automatic feeding, orienting, sizing and positioning of an envelope in the printing mechanism according to the logic diagrams of FIGS. 11 and 12. In the absence of both an envelope at sensor A and address data, decision blocks 152 and 154 of a main controller 150 (FIG. 11) maintain the program inactive. If address data arrives before an envelope is inserted, block 156 buffers the data and block 158 waits for insertion of an envelope, after which it forms a path through envelope controller subroutine 160 (FIG. 12) where block 162 causes line feed stepping motor 144 to roll the envelope into slots 112 and 114. If the envelope becomes skewed during movement toward sensors B and C, motor 144 continues to feed the envelope after its edge reaches proximity to either sensor B or C, and tends to correct the tilt. Block 164 stops line feed, if, after a predetermined count of lines, either sensor B or C has not detected the envelope. In such event, block 166 of main controller 150 allows the user to press a PRINT START button enabling block 168 to print the address and return the process to main controller 150.

If the line count has not run out, block 170 determines whether both sensors B and C detect the bottom of the envelope. If both sensors are detected, block 172 determines whether the envelope is still detected by sensor A. If so, block 174 determines the envelope as being "tall" and returns the process to block 166 (FIG. 11) for processing in the manner described above.

If block 172 determines that sensor A detects no envelope in the presence of signals from sensors B and C, block 176 determines it to be a "short" envelope and block 178 causes line feed motor 144 to roll the envelope back out of slots 112 and 114 until block 180 determines that sensor A detects the envelope. Block 182 measures the distance h traveled back by the envelope by counting the line feed motor "steps". The distance h is then subtracted from distance d to determine the height of the envelope. With the height of the envelope determined, the correct position for the first printed line of the address can be computed by subtracting a distance j corresponding to an average address height, i.e. three to five lines at six to eight lines per inch (2.36 to 3.15 lines per cm), and dividing the remainder by two. Subtracting from this quotient a preselected distance k between the print line and sensor A, block 184 causes line feed motor 144 to roll the envelope a distance m to arrive at the correct printing location. The computation is represented by the following equation:

$$m = \left[ \frac{(d - h) - j}{2} \right] - k$$

Upon reading the correct printing location, subroutine 160 returns to block 166 of the main controller and proceeds in the same manner described above.

If sensor A detects an envelope before any data arrives, subroutine 160 is promptly executed in the manner described for a "short" or "tall" envelope and causes block 188 to wait for the arrival of address data, after which it prints at block 168.

Many modifications can be made to the printing mechanisms described. For example, in the version of FIGS. 1–4, where the overall height of the printer is not a problem, bottom wall 58 can be located below the level of the lower ends of the slots in the side walls. The housing 62 in FIGS. 5 and 6 can be similarly modified. The printer housing can be provided in a version in which one of the side wall slots, e.g. slot 54 or 56 in FIGS. 1–4, is eliminated. Inverted character generation can be accomplished by means of software rather than a character memory chip, and selectable character reversal can be accomplished by reinterpreting conventionally generated characters. Inkjet, thermal or other print means may be substituted for a standard dot matrix print head. Other modifications will occur to persons skilled in the art, and can be made to the apparatus described without departing from the scope of the invention as defined in the following claims.

I claim:

1. An envelope printer comprising:

a housing; and printing means, located within the housing, for printing characters in printed lines on a portion of the face of an envelope;

the housing having an end wall, and also having two side walls extending substantially perpendicularly from said end wall and substantially parallel to and opposite each other, with openings in said end wall and said sides walls forming a continuous U-shaped slot for receiving an envelope and permitting three edges of the envelope to be located entirely outside the housing while said portion of the face of the envelope is within said housing and in position to be printed by said printing means, the opening in the end wall extending substantially parallel to the lengths of said printed lines, and the openings in the side walls extending substantially parallel to each other and substantially perpendicular to said opening in the end wall, and being spaced from each other by a distance in the range of approximately 12.7 cm. to 21.6 cm.; and wherein the elements of the printer are constructed and arranged to provide a clearance permitting an envelope to remain entirely in a substantially flat condition while the envelope is being printed.

2. An envelope printing mechanism according to claim 1 in which the openings in the side walls are spaced from each other by a distance in the range of approximately 12.7 cm. to 15.3 cm.

3. Apparatus for printing lines of characters on a flat document, comprising, in combination:

a first member having a rectilinear surface for engaging one side of the document parallel to the lines;

a second member having a cylindrical surface on an axis parallel to said rectilinear surface for frictionally engaging the other side of the document along said rectilinear surface;

a print head disposed adjacent to said first and second members for printing the characters;

drive means rotatingly connected to said second member for effecting line feed movement of the document; and two side panels substantially parallel to and opposite each other supporting the ends of said first and second members, said members having coplanar slots for receiving the document and spaced from each other by a distance in the range of approximately 12.7 cm to 21.6 cm.

4. Apparatus according to claim 3 wherein:

said side panels are spaced from each other by a distance in the range of approximately 12.7 cm to 15.3 cm.

5. An envelope printer comprising:

a housing;

printing means, located within the housing, for printing characters in printed lines on a portion of the face of an envelope;

the housing having an end wall, and also having two side walls extending substantially perpendicularly from said end wall and substantially parallel to and opposite each other, with openings in said end wall and said side walls forming a continuous U-shaped slot for receiving an envelope and permitting three edges of the envelope to be located entirely outside the housing while said portion of the face of the envelope is within said housing and in position to be printed by said printing means, the opening in the end wall extending substantially parallel to the lengths of said printed lines, and the openings in the side walls extending substantially parallel to each other and substantially perpendicular to said opening in the end wall;

limit means, located within the housing, for engaging an edge of the envelope and limiting the extent to which the envelope can be inserted into said U-shaped slot through said opening in the end wall;

first sensor means, located adjacent to the opening in said slot, for providing a signal when a portion of an envelope is adjacent to said first sensor means;

second sensor means, located within the housing, adjacent to said limit means, for providing a signal when an edge of the envelope is in proximity to said limit means;

reversible feeding means, located within the housing, for engaging said envelope and feeding the envelope, into said slot and outward from said slot, in directions substantially perpendicular to said opening in the end wall; and control means, responsive to the signals produced by said first and second sensor means, said control means operating said reversible feeding means in a first direction, when an envelope is inserted into said U-shaped slot, to move the envelope toward said limit means; stopping the operation of said reversible feeding means in said first direction when the envelope reaches said limit means; and operating said reversible feeding means in the opposite direction, if the envelope has cleared said first sensor, to cause the envelope to move in the direction away from said limit means to a printing position before said printing means begins to print characters;

wherein the elements of the printer are constructed and arranged to provide a clearance permitting an envelope to remain entirely in a substantially flat condition while the envelope is being printed.

6. An envelope printer according to claim 5 in which:

said second sensor means comprises two sensors spaced from each other in a direction parallel to the opening in said end wall; and said signal provided by the second sensor means is provided when an edge of the envelope is in proximity to both of said two sensors;

whereby, if the envelope becomes tilted during movement toward said limit means, the reversible feeding means continues to feed the envelope after the edge of the envelope reaches proximity to one of said two sensors and tends to correct the tilt of the envelope.

7. An envelope printer according to claim 5 in which:

said second sensor means comprises two sensors spaced from each other in a direction parallel to the opening in said end wall;

said signal provided by the second sensor means is provided when an edge of the envelope is in proximity to both of said two sensors; and said control means also effects stopping of the operation of the reversible feeding means in its first direction after a predetermined delay following the detection of an edge of the envelope by one of said two sensors, even if the edge of the envelope is not detected by the other of said two sensors.

8. An envelope printer according to claim 5 in which said control means causes the reversible feeding means to move the envelope in the direction away from said limit means by a predetermined distance.

9. An envelope printer according to claim 5 in which said control means determines the extent of movement of said reversible feeding means in said opposite direction from the beginning of its operation in said opposite direction until the first sensor means provides a signal indicating the proximity of the envelope to said first sensor means, and causes said reversible feeding means to continue to operate in said opposite direction to move the envelope in the direction outward from said U-shaped slot through a distance depending on, and varying with said extent of movement of the reversible feeding means.

10. An envelope printer according to claim 5 in which said control means determines the extent of movement of said reversible feeding means in said opposite direction from the beginning of its operation in said opposite direction until the first sensor means provides a signal indicating the proximity of the envelope to said first sensor means, and causes said reversible feeding means to continue to operate in said opposite direction to move the envelope in the direction outward from said U-shaped slot through a distance depending on, and varying inversely with said extent of movement of the reversible feeding means, whereby taller envelopes, other than envelopes which activate both the first and second sensor means simultaneously, are moved outwardly through greater distances than are shorter envelopes.

11. Apparatus for printing lines of characters on a flat document, comprising, in combination:

a first member having a rectilinear surface for engaging one side of the document parallel to the lines;

a second member having a cylindrical surface on an axis parallel to said rectilinear surface for frictionally engaging the other side of the document along said rectilinear surface;

a print head disposed adjacent to said first and second members for printing the characters;

drive means rotatingly connected to said second member for effecting line feed movement of the document;

first sensor means located adjacent to said rectilinear surface for providing a signal in the presence of the document;

second sensor means spaced from said first sensor means for providing a signal when the document is at a predetermined limit of line feed; and control means, responsive to the signals produced by said first and second sensor means, said control means operating said first drive means in a first direction, when the document is inserted between said first and second members to move the document toward said second sensor means; stopping the operation of said first drive means in said first direction when the document reaches said second sensor means; and operating said first drive means in the opposite direction, if the document has cleared said first sensor means, to cause the document to move in the direction away from said second sensor means to a printing position before said print head begins to print characters.

12. Apparatus according to claim 11 in which the distance between said first and second sensor means is in the range of approximately 10.8 cm. to 15.2 cm.

13. Apparatus according to claim 11 in which the distance from the location at which said second member engages the document and said second sensor means is approximately 8.9 cm.

14. Apparatus according to claim 11 in which the distance from said printing line to said second sensor means is in the range of approximately 11.4 cm. to 12.7 cm.

15. Apparatus according to claim 11 in which:

the distance from said first and second sensor means is in the range of approximately 10.8 cm. to 15.2 cm.;

the distance from the location at which said second member engages the document and said second sensor means is approximately 8.9 cm.; and the distance between said printing line to said second sensor means is in the range of approximately 11.4 cm. to 12.7 cm.

16. Apparatus according to claim 11 in which:

said second sensor means comprises two sensors spaced from each other in a direction parallel to the printing line; and said signal provided by the second sensor means is provided when an edge of the document is in proximity to both of said sensors;

whereby, if the document becomes tilted during movement toward said second sensor means, the first drive means continues to feed the document after the edge of the document reaches proximity to one of said two sensors and tends to correct the tilt of the document.

17. A printing mechanism for envelopes and the like, comprising:

a platen;

printing means comprising a print head located adjacent to the platen with sufficient clearance for effecting printing of characters along a printing line on the envelope inserted top first or bottom first entirely within a plane located between the print head and the platen;

first drive means for effecting print head movement in one direction relative to said platen with printing of each character;

second drive means for effecting envelope movement in one direction with printing of each line;

data buffer means for receiving the characters of an address to be printed, said data buffer means being selectably operable in a first-in, first-out sequence or in a last-in, first out sequence;

means establishing two alternatively selectable character sets;

print head driving means, for receiving data from the data buffer means, the print head driving means being responsive to the character set establishing means, and to said data buffer means, for printing characters on the envelope; and switching means, controlling said character set establishing means and said data buffer means, for selecting one of said character sets and for selecting either a first-in, first-out sequence or a last-in, first-out sequence in said data buffer means;

whereby characters can be printed in a first-in, first-out sequence in one of said character sets, and alternatively in a last-in, first-out sequence in the other of said character sets.

18. A printing mechanism according to claim 17 in which one of said alternatively selectable character sets is a set of upright characters, and the other of said sets is a set of inverted characters; and in which said switching means is operable to select simultaneously said set of upright characters and said first-in, first-out sequence in said data buffer means, or alternatively said set of inverted characters and said last-in, first-out sequence in said data buffer means; whereby, when the envelope is inserted bottom first the set of upright characters can be printed in a first-in, first-out sequence, and when the envelope is inserted top first, the set of inverted characters can be printed in a last-in, first out sequence.

19. A printing mechanism according to claim 18 wherein the relative arrangement of the characters in either sequence is the same.

* * * * *